United States Patent [19]

Hall

[11] 3,976,558

[45] Aug. 24, 1976

[54] METHOD AND APPARATUS FOR PYROLYZING OIL SHALE

[76] Inventor: Robert N. Hall, 3578 Perada Drive, Walnut Creek, Calif. 94598

[22] Filed: June 26, 1974

[21] Appl. No.: 483,218

[52] U.S. Cl. ..... 208/11 R; 201/12; 201/31; 202/120; 202/221

[51] Int. Cl.[2] ..... C10G 1/02; C10B 49/16; C10B 1/04

[58] Field of Search ..... 208/11; 201/7, 8, 10, 201/12, 14–16, 18, 31, 5, 20; 202/105, 120, 217, 221, 225

[56] References Cited

UNITED STATES PATENTS

| | | | |
|---|---|---|---|
| 2,738,315 | 3/1956 | Martin et al. | 201/31 |
| 3,004,898 | 10/1961 | Deering | 208/11 |
| 3,167,494 | 1/1965 | Crawford | 208/11 |
| 3,281,349 | 10/1966 | Evans | 208/11 |
| 3,491,016 | 1/1970 | Gomory | 208/8 |
| 3,496,094 | 2/1970 | Smith | 208/8 |
| 3,499,834 | 3/1970 | Goins | 208/11 |
| 3,597,347 | 8/1971 | Ellington | 201/7 |
| 3,691,056 | 9/1972 | Barney et al. | 208/11 R |

*Primary Examiner*—Delbert E. Gantz
*Assistant Examiner*—James W. Hellwege
*Attorney, Agent, or Firm*—Max L. Wymore

[57] ABSTRACT

Heat from spent shale combustion is removed from shale ash and combustion gases by direct contact thereof with raw shale particles wherein the fine raw shale particles not easily separable from the shale ash are removed prior to contact of the raw shale with the shale ash and combustion gases.

21 Claims, 1 Drawing Figure

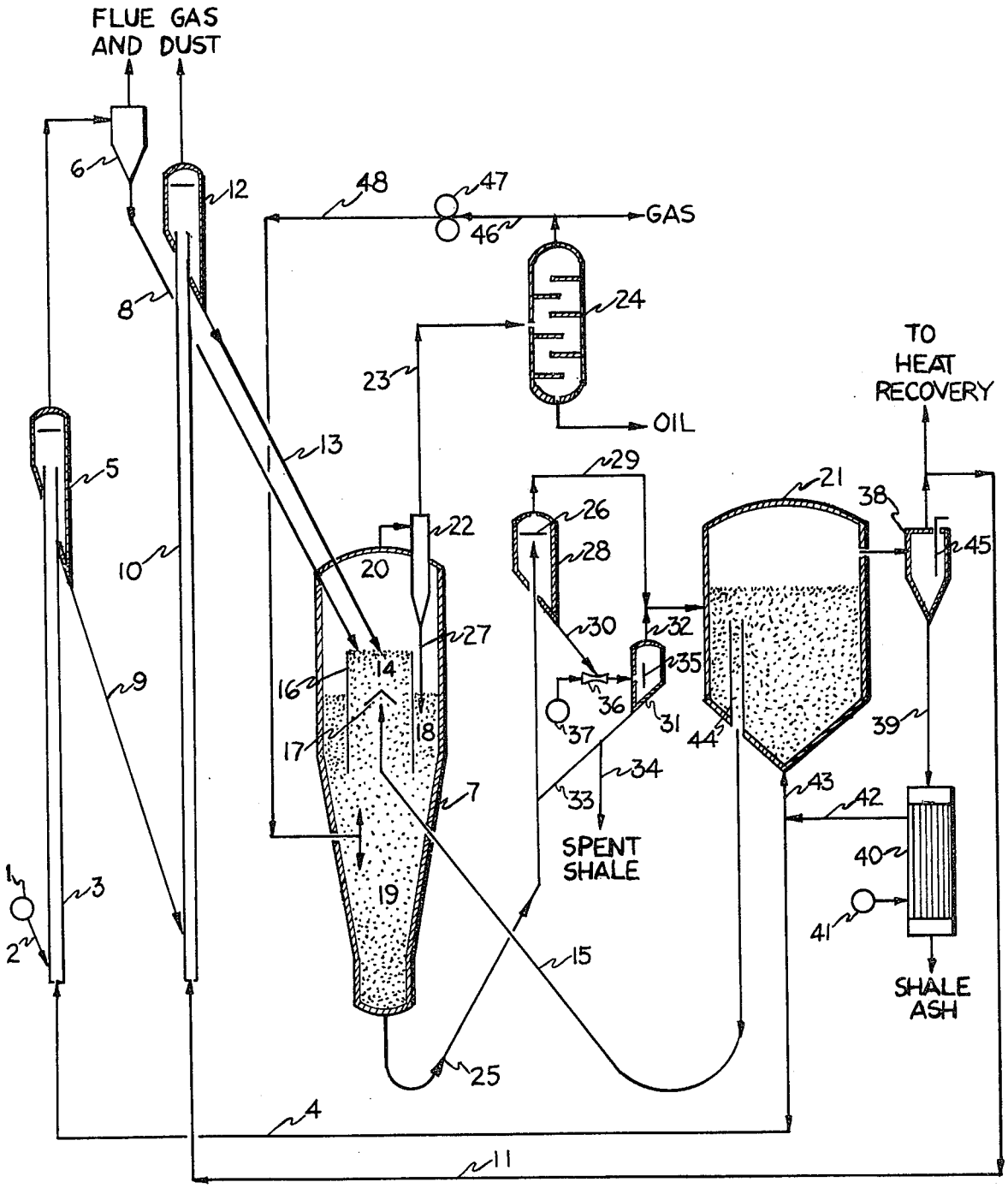
FLUE GAS
AND DUST
GAS
OIL
TO
HEAT
RECOVERY
SPENT
SHALE
SHALE
ASH

METHOD AND APPARATUS FOR PYROLYZING OIL SHALE

The present invention relates to a method and apparatus for the efficient and economic recovery of the heat produced by spent shale combustion.

BACKGROUND INFORMATION

It has been reported by the Colorado School of Mines that the inorganic portion of Green River oil shales contains around 15 weight per cent calcite ($CaCO_3$) and about 35 weight per cent dolomite ($CaCO_3.MgCO_3$). Decomposition of the carbonates begins at around 1300°F and proceeds rapidly above 1600°F. Care must be taken to control the amount of carbonate decomposition during spent shale combustion, since this reaction is highly endothermic and will negate the exothermic heat of combustion of the carbon on the spent shale.

Green River oil shale actually is not a shale but is a marlstone with the kerogen acting as a binder to hold together the finely divided inorganic particles. The kerogen is decomposed during pyrolysis and the spent shale produced has little compressive strength, tending to disintegrate when minor forces are applied. Combustion of the carbon on the spent shale removes the remaining binder and, coupled with carbonate decomposition, the resulting shale ash is extremely friable, being produced predominantly as a powder-like residue.

Several processes, such as those disclosed by U.S. Pat. Nos. 2,480,670 and 3,597,347 propose that the shale ash be recycled to the pyrolysis vessel to provide the heat required for retorting. Other processes, such as disclosed by U.S. Pat. Nos. 2,983,653 and 3,655,518, propose that a heat carrier together with a portion of the shale ash be recycled to the pyrolysis vessel to provide the heat required for retorting. Control of the flow of such finely divided material and the potential of contamination of the oil product with bottoms sediment resulting from the entrainment of shale ash into the pyrolysis vapors are two of the major problems faced by such processes.

U.S. Pat. Nos. 2,634,233 and 3,691,056 point out another problem of the adsorption of pyrolysis vapors on the shale ash. The latter patent discloses a method whereby heat recovery is accomplished while substantially reducing the amount of shale ash circulating to the pyrolysis vessel.

SUMMARY OF THE INVENTION

A finely divided heat carrier, such as catalytic cracking catalyst, would be circulated between a pyrolysis vessel and a spent shale burner. Both the pyrolysis vessel and the burner would be operated as fluid beds, with special apparatus used for maintaining fluidity of the pyrolysis bed and for achieving efficient burning and shale ash separation in the combustion bed.

A portion of the shale ash would be used for direct heat transfer to preheat the raw shale prior to pyrolysis, thus cooling this portion of the shale ash and facilitating disposal.

A slip stream of the lighter fraction of the pyrolysis vapor would be recycled to the pyrolysis zone to permit controlled fluidization and to accomplish improved heat transfer.

To prevent attrition of the heat carrier, the heat carrier would be separated from the larger spent shale particles prior to entering the spent shale burner, with the larger spent shale particles, free of heat carrier, being pulverized separately and injected into the fluid bed burner.

DETAILED DESCRIPTION OF THE INVENTION

The invention is described in detail in the following paragraphs and further illustrated by the accompanying drawing which presents a schematic diagram of the method and apparatus.

Crushed raw shale from source 1, nominally ¼ inch or less in particle size is introduced through line 2 into the bottom of first stage preheater 3, which is a concurrent, direct contact heat exchanger, with the raw shale particles being entrained hot dust-free vapor for a short period of time. In the embodiment of the invention, the dust-free vapor is air which has been heated by indirect heat exchange with hot shale ash to around 1,000°F. The air would be introduced into the bottom of first stage preheater 3 via line 4. The raw shale will thus be heated to approximately 250°F and the air would be cooled to around 350°F. The gas velocity during preheating would be approximately 10 per cent greater than the drop-out velocity for ¼inch shale particles at the preheater exit, that is, a velocity of approximately 75 feet per second.

The shale and warm air would exit the top of first stage preheater 3 into shale fines elutriator 5. Elutriation would be accomplished in a vessel having a cross-sectional area such that shale particles greater in size than around 100 mesh would "drop out." The minus 100 mesh shale particles, which is around 5 per cent of the total shale quantity, and which depends to a great extent upon the method of crushing, would be entrained and pass through shale fines cyclone 6 and the fine shale particles removed will flow via line 8 directly to pyrolyzer 7. The warm air and a small amount of raw shale dust will exit shale fines cyclone 6 to be processed in dust removal facilities before venting to the atmosphere.

The warm raw shale particles larger in size than 100 mesh (plus 100 mesh) will flow through line 9 to the bottom of second stage preheater 10, which is also a concurrent, direct contact heat exchanger, similar in design to first stage preheater 3. Hot flue gas and entrained shale ash from shale ash cyclone 38 at around 1350°F will be injected via line 11 into the bottom of second stage preheater 10. The entrained shale ash is a finely divided material consisting of particles predominantly less than 200 mesh in size. The warm flue gas, warm ash and plus 100 mesh preheated raw shale will exit into shale ash elutriator 12. Elutriation will be accomplished in a vessel having a cross-sectional area whereby the plus 100 mesh raw shale particles will drop out and the finely divided shale ash will be entrained overhead. The exit warm flue gas and warm shale ash from shale ash elutriator 12 will flow through dust removal facilities before venting to the atmosphere.

The plus 100 mesh raw shale particles will flow through line 13 to pyrolyzer 7. More than two stages of preheat can be used for greater heat efficiency if desired, with series units of similar design. The plus 100 mesh shale can be preheated to around 600°F before any substantial pyrolysis will occur, for which condition the flue gas and shale ash would be cooled to approximately 700°F.

Heating a material such as oil shale with a solid heat carrier in a fluid bed is somewhat difficult due to the wide particle size range of the shale, coupled with the fact that the shale disintegrates to some extent upon pyrolysis. For example, if the shale and the heat carrier are introduced at the top of the bed, then those particles having a slightly higher settling velocity than the vapor velocity will accumulate in the upper part of the fluid bed and will tend to choke the flow of solids. If the heat carrier is introduced below the bed level, then a similar action will occur, that is, the smaller particles will still tend to accumulate and choke the flow. If the heat carrier is introduced at the bed level and shale below the bed level, the fines would still accumulate in the upper part of the bed and the vapors would be exposed to excessive cracking conditions. While a standpipe, typical as is used in a fluid catalytic cracking unit, could be used for removing the fines fraction, the bridging action of finely divided material in a pipe makes control of flow a problem.

The foregoing problem of fines accumulation in the pyrolysis fluid bed can be essentially eliminated by the technique as described in this paragraph. Main pyrolysis zone 14 would be provided inside of pyrolyzer 7, created by hollow cylinder 16, open at the top and bottom. The minus 100 mesh raw shale from shale fines cyclone 6 at around 250°F would be introduced through line 8 slightly below the bed level of pyrolysis zone 14. A shorter period of time would be required to pyrolyze the minus 100 mesh particles than for the plus 100 mesh fraction since the smaller particles would be heated more rapidly to pyrolyzing temperature. The plus 100 mesh raw shale which has been preheated to around 600°F, would be introduced via line 13 from shale ash elutriator 12 a short distance below the fluid bed level of pyrolysis zone 14. The hot heat carrier at around 1400°F would be introduced via heat carrier lift line 15 into the upper part of pyrolysis zone 14. A device, such as conical baffle 17, would deflect the heat carrier to prevent jetting action and to provide distribution. As the shale is pyrolyzed, the spent shale fines would be carried upward by elutriating action and will overflow the upper rim of hollow cylinder 16 into dormant annulus zone 18. The flow of spent shale fines would combine with the circulating heat carrier and larger spent shale particles in accumulator zone 19. Pyrolysis zone 14 would be designed to have a residence time of approximately two minutes, sufficient to achieve pyrolysis of the ¼ inch particles. Disengaging zone 20 above pyrolysis zone 14 would have a larger cross-sectional area than pyrolysis zone 14 to permit the larger spent shale particles which have been entrained with the pyrolysis vapor to drop out and fall into annulus zone 18.

While catalytic cracking catayst is the proposed heat carrier for achieving pyrolysis by this invention, other heat carriers, such as thermal shock resistant silica or alumina, could also be used. The heat carrier at around 1400°F would be transported from combustor 21 into pyrolyzer 7 by means of lift line 15, which would be of similar design to a conventional fluid catalytic cracker lift line. The flow rate of the circulating heat carrier would be controlled to maintain the temperature of pyrolysis around 875° to 900°F, at which temperature maximum oil yield will be obtained. This temperature control would be similar to that used in conventional fluid catalytic cracking technology.

Pyrolysis vapors would exit from the top of pyrolyzer 7 and pass through pyrolysis vapor cyclone 22 via line 23 to fractionator condenser 24, where the vapors would be partially condensed and separated into oil and gas. Further processing would be required to remove the hydrogen sulfide and carbon dioxide from the gas and the oil would have to be catalytically hydrotreated to remove the sulfur and nitrogen to produce a premium synthetic crude oil.

A slip stream of gas taken overhead from fractionator 24 via line 46 would be compressed by device 47 and recycled via line 48 to pyrolyzer 7 to permit controlled fluidization and improved heat transfer in pyrolysis zone 14. A small portion of this recycle gas stream would also be injected into the lower part of pyrolyzer 7 to prevent the formation of stagnant areas in accumulator zone 19, and thus eliminate "rat-holing" through this zone.

Warm heat carrier and spent shale would exit from the bottom of pyrolyzer 7 via lift line 25. Spent shale from pyrolysis vapor cyclone 22 would flow through seal leg 27, discharging below the level of the spent shale in annulus zone 18.

The heat for pyrolysis would be obtained by burning off the carbon on the spent shale. Calculations show that oil shale containing as low as 25 gallons per ton can be pyrolyzed using only that heat available from the carbon on the spent shale. Rather than inject the mixture of heat carrier and spent shale directly into combustor 21, the heat carrier, together with smaller spent shale particles, would be entrained overhead from heat carrier elutriator 28 and then fed to combustor 21 via line 29. Deflector baffle 26 would prevent jetting larger spent shale particles out the top of heat carrier elutriator 28. The larger spent shale particles would exit from the bottom of heat carrier elutriator 28 and then feed through line 30 into the throat of venturi 36, with high pressure steam or air from source 37 being used to eject the particles and jet them against wear resistant plate 35 in pulverizer 31. The smaller spent shale particles would be entrained overhead from pulverizer 31 via line 32 and transported into combustor 21. The larger spent shale particles are recycled back to heat carrier elutriator 28 via line 33. To prevent an accumulation of large spent shale particles in the system, a small amount of spent shale would be withdrawn via line 24. By such a feed preparation technique as described above, attrition of the heat carrier would be avoided, the energy required for pulverizing the spent shale would be low, the wear rate during impacting would be minimal, the amount of shale ash recycled with the heat carrier would be small, the carbon burn-off rate on the spent shale will be greatly accelerated and the fluidization during spent shale burning would be facilitated.

The carbon on the spent shale and on the heat carrier would be burned off at a temperature of around 1400°F in combustor 21. The temperature can be controlled by introduction of air in excess of that required for combustion. The shale ash thus formed by spent shale combustion is very friable and decrepitates to produce a material which consists predominantly of minus 200 mesh particles. Essentially all of the shale ash will be elutriated from combustor 21 with hot flue gas and flow through shale ash cyclone 38. The solids stream of hot shale ash from shale ash cyclone 38 will flow through line 39 to air preheater 40. The hot heat carrier at around 1400°F will exit combustor 21 through standpipe 44 and be transported to pyrolyzer 7 through lift line 15. Based on the operating conditions as herein described, the circulation rate of heat carrier to raw oil shale will be approximately one to one.

Compressor air from source 41 will be heated to around 1000°F in air preheater 40 by indirect heat exchange with the solids stream of hot shale ash from shale ash cyclone 38. The solids stream of cooled shale ash, which exits air preheater 40 at approximately 300°F, will be sent to disposal. The hot air will exit air preheater 40 via line 42 and the flow will be divided to provide combustion air to combustor 21 through line 43 and hot air for first stage preheater 3 via line 4.

Hot ash cyclone 38 will be provided with interrupter baffle 45 to control the desired amount of finely divided, hot shale ash particles to be entrained into the hot flue gas. By the method as defined herein, the shale ash will be intentionally introduced into the hot flue gas to supply a portion of the heat for second stage preheater 10. The velocity of the gas to preheater 10 is essentially a fixed rate, and since it is undesirable to change the spent shale combustion temperature, then the temperature to which the raw shale is heated in preheater 10 can be controlled by positioning interrupter baffle 45 to vary the amount of shale ash entrained into the flue gas.

The finely divided shale ash, thus cooled to around 700°F during raw shale preheat, is removed from the plus 100 mesh raw shale as previously described. The efficient use of the hot shale ash fines for supplying direct heat to the process is made possible by removal of the raw shale fines by shale fines elutriator 5 prior to being contacted with hot ash, whereby the loss of raw shale into the ash is prevented.

Pyrolyzer 7 will be operated at around 5 psig and combustor 21 at approximately 10 psig, with the pressure balance being accomplished by controlling the density of the solids-gas mixture in the spent shale and heat carrier lift lines.

Excess heat will be produced by the described invention when oil shale richer than around 25 gallons per ton is processed. This excess heat can be recovered by such a technique as the generation of steam in a waste heat boiler, utilizing the excess flue gas and entrained hot ash which would be produced from hot ash cyclone 38.

It is to be recognized tht modifications to the method and apparatus of the invention can be made by those skilled in the art from the descriptions as set forth herein, and, accordingly, the invention is to be limited only to the scope of the appended claims.

What is claimed is:

1. A process for the production of shale oil from oil shale whereby the heat produced by spent shale combustion is efficiently and economically recovered, comprising:

a. separating a fines fraction from the raw shale feed prior to pyrolysis to leave a larger size fraction readily separable from oil shale ash by suitable means;

b. preheating the larger size raw shale fraction with a mixture of finely divided hot shale ash and hot gas;

c. separating the shale ash from the preheated larger size raw shale;

d. pyrolyzing the raw shale, comprised of both the fine fraction and the larger size fraction in a fluid bed using a finely divided heat carrier, such as catalytic cracking catalyst;

e. controlling fluidization and heat transfer in the pyrolysis zone by the introduction of supplemental fluidizing vapor;

f. separating the heat carrier and small spent shale particles from the larger spent shale particles and feeding the heat carrier and small spent shale particles to a spent shale fluid bed combustion chamber;

g. separately pulverizing the larger spent shale particles and feeding same to a spent shale combustion chamber; and, h. recirculating the heat carrier to the pyrolysis fluid bed.

2. The process as defined in claim 1 wherein initial preheating of the raw shale is accomplished in conjunction with separating of a fines fraction from the raw shale.

3. The process as defined by claim 1 wherein initial preheating is accomplished by utilizing the heat recovered from indirect cooling of the residue from spent shale combustion.

4. The process as defined by claim 1 wherein the finely divided hot shale ash and hot gas used for preheating the larger size raw shale fraction are the finely divided residue and flue gas produced from spent shale combustion.

5. The process as defined by claim 1 wherein the supplemental fluidizing vapor for the pyrolysis zone is a recycle stream of the lighter fraction of pyrolysis vapor.

6. The method of claim 1 and further to prevent restricting the flow of solids through the pyrolysis vessel which comprises:

a. feeding the raw shale fines fraction to a location slightly beneath the surface of the pyrolysis fluid bed;

b. feeding the larger, preheated raw shale fraction beneath the surface of the pyrolysis fluid bed;

c. feeding the heat carrier into the pyrolysis fluid bed at a location beneath the larger raw shale fraction injection point;

d. providing a separate and distinct pyrolysis zone within the pyrolysis vessel; and, e. providing a dormant zone whereby the fines fraction of the spent shale can overflow and freely exit the pyrolysis vessel.

7. The method of claim 1 and further to prevent attrition of the heat carrier, to permit ease of burning the spent shale in the combustion vessel and to facilitate removal of the burned spent shale from the heat carrier, which steps are conducted prior to introduction of the spent shale and the heat carrier into the combustion vessel and comprises:

a. separating the heat carrier and small spent shale particles from the larger spent shale particles in a separating zone;

b. attriting the larger spent shale particles resulting from the separation of the heat carrier and small spent shale particles therefrom, such as by impacting against a wear plate;

c. recycling larger spent shale particles after attrition to said separating zone; and, d. withdrawing a portion of the larger spent shale particles to prevent build-up in the circuit.

8. A process for the production of shale oil from oil shale particles wherein the heat produced by spent shale combustion is recovered, which comprises the steps of:

a. separating the raw shale particles into a first fraction of a particle size sufficiently large and of a predetermined size to permit ready separation thereof from oil shale ash to leave a second fraction having particles of a size smaller than said predetermined size;

b. providing a hot combustion gas and shale ash third fraction having a particle size range substantially less than the particle size range of said second fraction of raw shale;

c. feeding said second fraction of raw shale directly to a pyrolysis fluidized bed;

d. concurrently contacting said hot shale ash third fraction directly with said first fraction of raw shale to heat said first fraction;

e. separating said shale ash third fraction from said first fraction of raw shale as a function of particle size;

f. feeding the heated first fraction of raw shale to said pyrolysis fluidized bed; and, g. pyrolyzing said raw shale in said pyrolysis fluidized bed.

9. The process of claim 8 wherein the second fines fraction of raw shale is comprised of particles predominantly of a particle size less than about 100 mesh.

10. The method of claim 8 wherein the second fraction of raw shale is introduced into the fluidized bed immediately beneath the surface and the first fraction of raw shale is introduced below the surface.

11. The method of claim 8 wherein the said pyrolysis fluidized bed includes a finely divided heat carrier and the further steps of:

a. forming a fluidized combustion bed of spent shale particles and finely divided heat carrier coming from the pyrolysis bed;

b. combusting the carbon on the spent shale and heat carrier particles in said combustion bed in a manner to form shale ash and to heat said heat carrier particles;

c. separating the shale ash from the heat carrier particles; and, d. recycling the hot heat carrier particles from said combustion bed into said pyrolysis fluidized bed.

12. The method of claim 11 including the steps of:

a. first separating the heat carrier and small spent shale particles from the larger spent shale particles and feeding the heat carrier and small spent shale particles directly to the fluidized combustion bed;

b. subjecting the larger spent shale particles to a size reduction step;

c. separating the fine spent shale prticles thus produced by size reduction by elutriation from the larger spent shale particles and introducing the fine spent shale particles into the fluidized combustion bed;

d. recycling the remaining larger spent shale particles back through the size reduction step that were not adequately comminuted during the said size reduction step; and, e. removing a small portion of the larger spent shale particles from the system after the size reduction step to prevent a build-up of non-comminutable particles in the circuit.

13. The method of claim 11 wherein combustion is carried out at a temperature between about 1300° and 1600°F.

14. A process for the production of shale oil from oil shale by pyrolysis wherein the heat produced by spent shale combustion is recovered from the combustion products, including hot shale ash and hot combustion gases, and wherein the raw shale is preheated by concurrent direct contact with the combustion products and the shale ash is introduced into the pyrolysis zone along with the preheated raw shale, the improvement which comprises separating the raw shale feed into a first fraction having particles of a size large enough to permit ready separation of the particles from oil shale ash, feeding the separated second small sized particle raw shale fraction directly to the oil shale pyrolysis zone; contacting the first fraction of raw shale with combustion gases containing shale ash resulting from the combustion of spent shale; separating the shale ash from the heated first raw shale fraction; and, feeding the heated first fraction less shale ash and combustion gases to the oil shale pyrolysis zone.

15. The process according to claim 14 wherein the separated second smaller sized fraction of raw oil shale is comprised of particles predominantly of a particle size less than about 100 mesh.

16. The process according to claim 14 wherein the pyrolysis zone is comprised of a fluidized bed of oil shale particles and heat carrier means having a central highly active zone and an outer quiescent zone and the raw shale feed is introduced into the active zone.

17. A pyrolysis means for oil shale which comprises a retorting chamber having an open-ended cylindrical baffle concentrically positioned therein to provide a central active pyrolysis zone and an outer annular dormant zone with an inverted conical baffle centrally positioned within said cylindrical baffle and inlet means positioned beneath the conical baffle adapted to direct hot heat carrier means there beneath.

18. Apparatus for the pyrolysis of oil shale which comprises:

a. first elutriating means for separating a predetermined first fine particle size fraction from finely divided raw oil shale;

b. heat exchange means adapted to and receiving a larger particle size second fraction of a raw oil shale in direct heat exchange relation with hot shale ash and flue gas to heat the larger size fraction;

c. means operatively connected with said heat exchange means and adapted to separate the shale ash from the heated larger particle size second fraction of raw oil shale;

d. pyrolysis means having a fluidized bed of oil shale, heat carrier and hot gases;

e. means for passing the first and second raw shale fraction into said pyrolysis means;

f. means for introducing hot heat carrier and hot gas into the interior of the fluidized bed of said pyrolysis means;

g. means for withdrawing pyrolysis vapors from said pyrolysis means;

h. means for withdrawing spent shale and heat carrier from the pyrolysis means, i. spent shale combustion means;

j. means for feeding spent shale and heat carrier to said spent shale combustion means along with combustion air to burn the carbon on the spent shale and the heat carrier;

k. means for separating a portion of the hot shale ash from flue gas issuing from said spent shale combustion means; and, l. means for feeding hot shale ash and flue gas to said heat exchange means; and, wherein the pyrolysis means comprises a retorting chamber having an open-ended cylindrical baffle concentrically positioned therein to provide a central active pyrolysis zone and an outer annular dormant zone with an inverted conical baffle centrally positioned within said cylindrical baffle, beneath which is directed the hot heat carrier from said spent shale combustion means.

19. Apparatus for the pyrolysis of oil shale which comprises:

a. first elutriating means for separating a predetermined first fine particle size fraction from finely divided raw oil shale;

b. heat exchange means adapted to and receiving a larger particle size second fraction of the raw oil shale in direct heat exchange relation with hot shale ash and flue gas to heat the larger size fraction;

c. means operatively connected with said heat exchange means and adapted to separate the shale ash from the heated larger particle size second fraction of raw oil shale;

d. pyrolysis means having a fluidized bed of oil shale, heat carrier and hot gases;

e. means for passing the first and second raw shale fraction into said pyrolysis means;

f. means for introducing hot heat carrier and hot gas into the interior of the fluidized bed of said pyrolysis means;

g. means for withdrawing pyrolysis vapors from said pyrolysis means;

h. means for withdrawing spent shale and heat carrier from the pyrolysis means;

i. spent shale combustion means;

j. means for feeding spent shale and heat carrier to said spent shale combustion means along with combustion air to burn the carbon on the spent shale and the heat carrier;

k. means for separating a portion of the hot shale ash from flue gas issuing from said spent shale combustion means; and, l. means for feeding hot shale ash and flue gas to said heat exchange means.

20. The apparatus of claim 19 including:

a. means for separating the heat carrier and fine spent shale particles from the larger size spent shale particles withdrawn from said pyrolysis means;

b. means for separately comminuting said larger sized spent shale particles; and, c. means for delivering the comminuted larger sized spent shale particles to said spent shale combustion means.

21. Apparatus according to claim 19 wherein the pyrolysis means includes a retort having internal baffle means positioned in the upper extremity thereof adapted to provide an active pyrolysis zone and an adjacent dormant zone and the means for passing the first and second raw shale fraction into the pyrolysis zone is positioned to discharge raw shale into the active pyrolysis zone.

* * * * *